US005787621A

United States Patent [19]

Leksell

[11] Patent Number: 5,787,621

[45] Date of Patent: Aug. 4, 1998

[54] DISPLAY STAND

[76] Inventor: Carl Leksell, SE-412 55, Göteborg, Sweden

[21] Appl. No.: 630,551

[22] Filed: Apr. 10, 1996

[51] Int. Cl.[6] ..... G09F 15/00

[52] U.S. Cl. ..... 40/606; 40/610; 52/726.1

[58] Field of Search ..... 40/606, 607, 610; 160/351; 52/46, 38, 730.1, 736.3, 738.1, 726.1

[56] References Cited

U.S. PATENT DOCUMENTS 3,570,376 3/1971 Overton ..... 52/736.3 X
4,425,728 1/1984 Elliot ..... 40/607

FOREIGN PATENT DOCUMENTS 364690 11/1962 Switzerland ..... 40/607

*Primary Examiner*—Kenneth J. Dorner
*Assistant Examiner*—Cassandra Davis
*Attorney, Agent, or Firm*—Knobbe,Martens,Olson & Bear, LLP

[57] ABSTRACT

A display stand comprises collapsible elements which are quickly and easily assembled into a stable configuration without the use of tools. The elements can be shipped in a substantially flat container to reduce shipping expenses. Vertical supports are mounted to a base to securely hold display units having messages and/or photographs for viewing. The display units have curved outer surfaces to facilitate viewing from other than directly in front or from the rear of the display stand. A header can be attached to the top of the display stand to further draw the attention of individuals.

22 Claims, 6 Drawing Sheets

DISPLAY STAND

BACKGROUND OF THE INVENTION

The present invention relates to advertising displays and, in particular, to a display stand which is easily transported.

Temporary, portable advertising displays are found at conventions, trade shows, retail stores and lobbies of movie theaters. The displays are often elaborate constructions requiring special shipping containers and setup procedures. Simpler displays include tripod or easel type arrangements for holding a simple poster board. Many of these displays, because they are typically made for limited use or viewing, require complicated and heavy support structures to achieve a visual impact on a viewer.

One type of display stand comprises a generally rectangular cardboard box having a narrow profile when viewed from the side. Photographs or advertising messages are provided on the larger, outer surfaces of the box which is best viewed from the front or rear of the display stand. Two short, lateral members or feet support the stand and extend a short distance upwardly into the bottom of the rectangular box, adjacent the narrow sides of the box. Small inserts can be placed at the upper ends of the narrow sides of the box to support another rectangular box mounted on top of the lower box. The feet at the bottom of the boxes and the small inserts between the boxes provide limited stability and support for the display, such that the upper or both boxes can be knocked over if a strong gust of wind or other force is applied to the stacked boxes.

Another type of display stand utilizes similar narrow, rectangular boxes mounted onto an inverted V-shape base. This base may also have printed material provided on its upper surface, extending on either side between the two pairs of feet which are in contact with the ground. These feet extend laterally somewhat farther away from the display surfaces of the rectangular boxes, thus affording somewhat more stability at the bottom of the boxes. However, this base also raises the rectangular boxes off the ground, therefore resulting in an even higher profile for the stacked boxes. Because only thin inserts typically connect and support a stacked pair of boxes, one or both rectangular boxes are subject to being knocked over.

SUMMARY OF THE INVENTION

The display stand of the present invention advantageously provides a stable arrangement which can be stacked up to five units high. The curvature of the display surfaces enables viewing from a wider range of angles. The collapsible elements comprising this display stand are quickly and easily assembled without tools for immediate display. And, the elements can be shipped in a substantially flat container, thus reducing shipping costs.

In one aspect of the present invention, a pair of display units having printed matter on their curved outer surfaces are stacked one upon the other. Although the display units preferably having a generally elliptic shape, other display shapes such as hexagonal or cylindrical may be used. The display units fold substantially flat to rectangular shapes of about 20×30×2.5 inches or 30×40×2.5 inches, for example, for shipping and storage. Preferably these units are supported on the display stand by a substantially X-shaped base and a pair of generally rectangular support columns. The base and support columns are configured to be substantially flat for storage. The lower support column mounts onto the base, and the upper support column detachably secures to the lower column using card-like connectors which fit closely into the top of the lower column and the bottom of the upper column. The display units mount around the support columns, with the lower unit resting atop the base and the upper unit resting on top of the lower unit. In alternative embodiments, additional display units can be stacked to form a display stand of the present invention, utilizing a corresponding number of additional support columns and additional pairs of connector cards to secure the columns to each other.

Preferably, alignment tabs are provided at the junction of the folded sides of the display units. The tabs may be secured by adhesive or pockets on the inside of the display units may be provided to receive the tabs. Also preferably, the mating ends of the upper and lower support columns have flaps which engage on the inside of their respective columns. The flaps engage to form V-shapes which help the columns maintain their generally square cross-sectional shape and also help secure the cards at the column ends.

In a preferred embodiment, a display header is provided at the top of the display units. The header comprises a display portion which substantially encircles the top of the display stand and connector portions to be securely received into the top of the uppermost support column. Preferably, the connector portions are similar to the connector cards in that they insert into spaces between that column's flaps and the sides of the columns.

In the preferred embodiments, the base comprises a pair of members formed from extruded plastic. The support columns and display units are preferably formed from E-flute cardboard and are varnished on both sides. The printed material, such as photographs or advertising messages, are conventionally printed onto the outer surfaces of the display units. Preferably, a natural glue is used to form the collapsible display units and support columns, in order to accommodate recycling of the cardboard when that particular display stand is no longer useful. The base is reusable, as are the support columns, with other display units customized for another advertiser.

In another aspect of the present invention, a preferred method of constructing a display stand of the present invention comprises the steps of i) providing a base; ii) mounting a first support column on top of the base with a portion of the base received into the bottom of the first column; iii) inserting cards into the top of the first column; iv) mounting a second support column on top of the first column wherein the cards are removably received into the bottom of the second column; v) arranging a first display unit around the first column and resting on top of the base; and vi) arranging a second display unit around the second column so that the second display unit rests on top of the first display unit.

Steps iii), iv) and vi) may be repeated for any number of display units and columns, although, it is preferred that up to about five of each are stacked. Further, this method may comprise the step of providing alignment tabs between adjacent display units. In addition, the method may further comprise the step of detachably arranging a display header on the top of the uppermost display unit.

Thus, a display stand constructed in accordance with the present invention can obtain a substantial vertical height while maintaining stability through the use of the interior support columns which removably and securely mount onto the base. The curved surfaces of the display units facilitate viewing at a distance from the display stand and from a variety of angles. The elements including the base, inner supports, outer display units, connectors and header easily fold flat for storage. Thus, a substantially flat container can be used for shipping, thereby reducing costs. The display stand is quickly assembled on-site without tools.

Further advantages and applications will become apparent to those skilled in the art from the following detailed description and the drawings referenced herein.

DETAILED DESCRIPTION OF THE PREFERRED EMBODIMENTS

Figure 1:
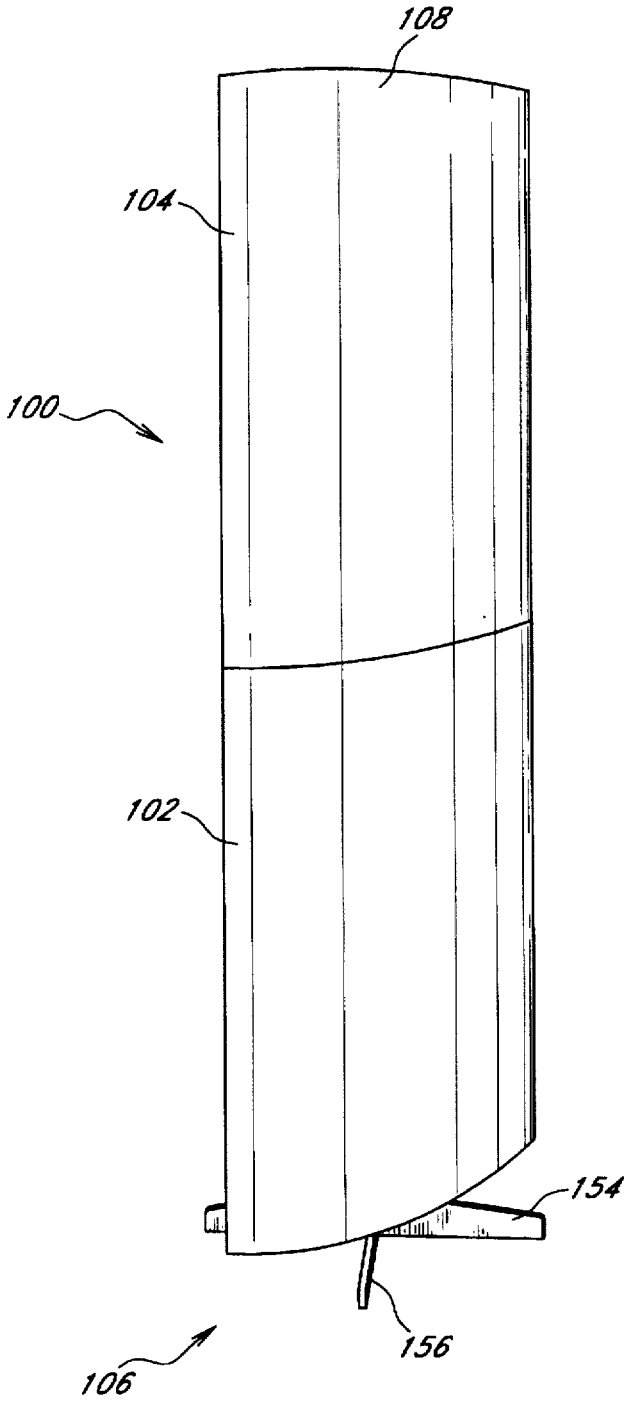
FIG. 1 is a perspective view of a preferred embodiment of a display stand of the present invention illustrating a pair of stacked display units.
Figure 2:
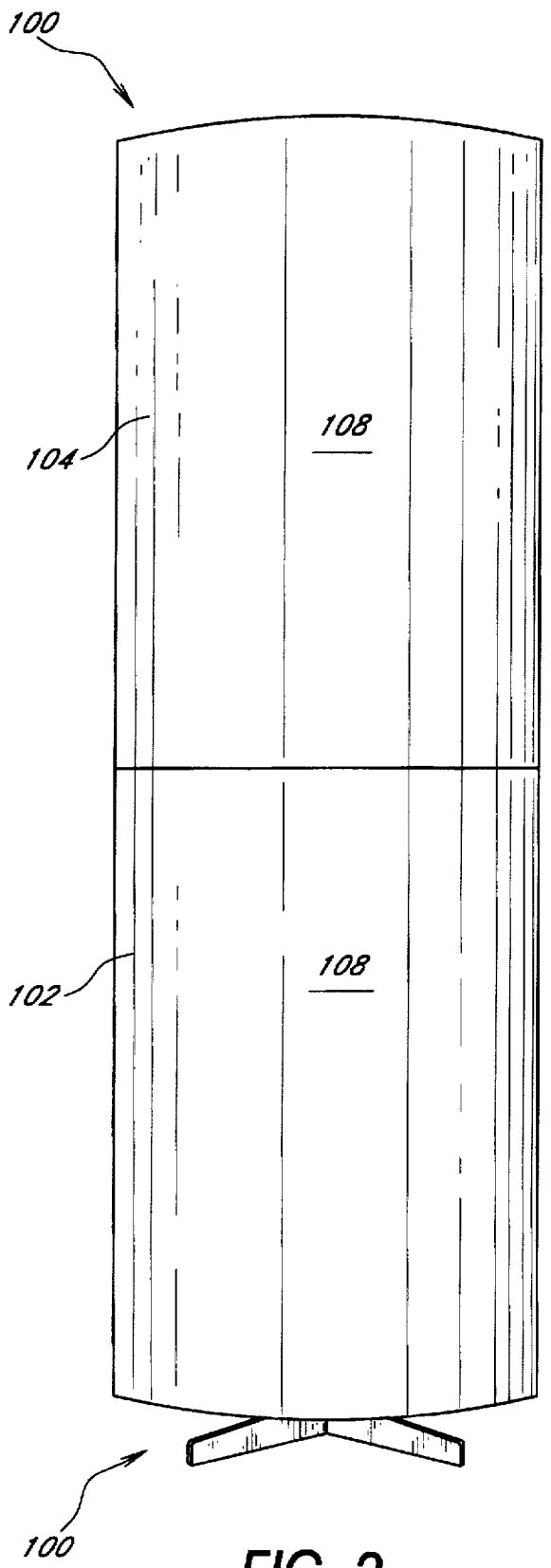
FIG. 2 is a front elevational view of the embodiment of FIG. 1 and is a mirror image of the rear elevational view.
Figure 3:
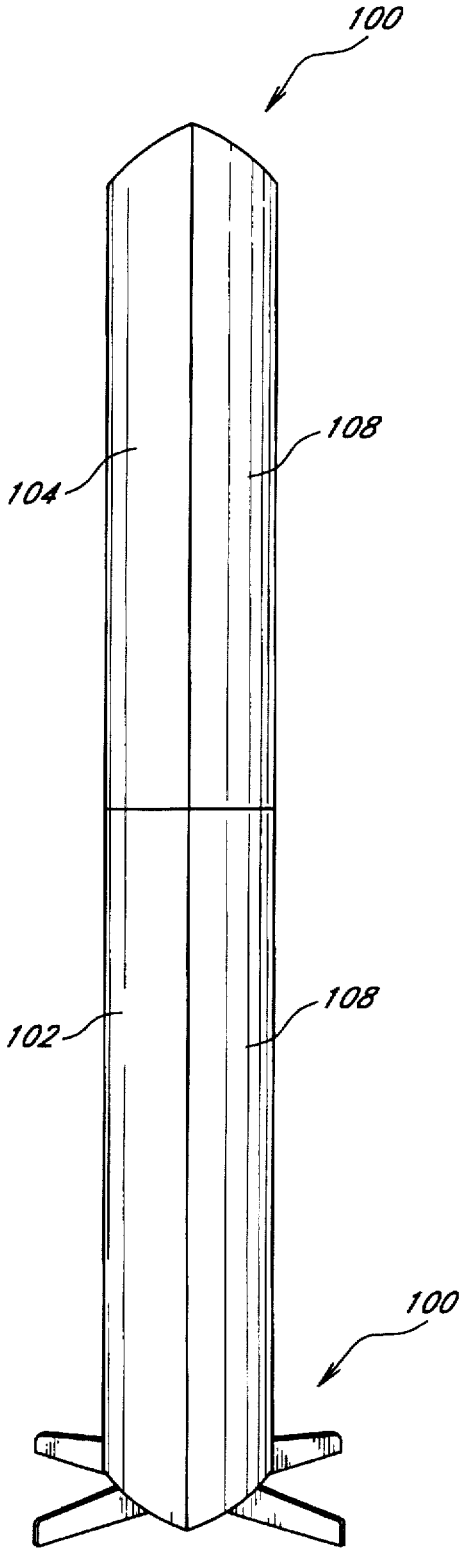
FIG. 3 is a side elevational view of the embodiment of FIG. 1.

A preferred embodiment of a display stand 100 of the present invention is shown in FIGS. 1–3 and generally comprises a pair of display units 102, 104 stacked on top of a substantially X-shaped base 106. As more clearly shown in FIGS. 4 and 5, the display units 102, 104 are shaped to have curved surfaces 108 with a horizontal cross-section that is substantially the shape of an ellipse. Printed material such as photographs or advertising messages are provided on the outer surfaces 108 of the units 102, 104 in a manner known to those skilled in the art. The curved outer shape facilitates viewing of the messages from a distance and at a range of angles from the display stand 100, unlike flat surfaces. In alternative embodiments, the display units may be shaped to have cross-sections of other shapes, such as hexagonal or other polygons, as desired.

Referring to FIGS. 2 and 3, the display units 102, 104 are preferably formed with generally rectangular shapes, and the units fold substantially flat for storage and shipping. As described in greater detail in connection with FIG. 6, vertical supports 110, 112, stacked using card-like connectors 114 between adjacent supports, are placed inside the display units 102, 104 to provide stability to the display stand 100. In addition, alignment elements 116 maintain the display units 102, 104 in alignment.

Figure 4:
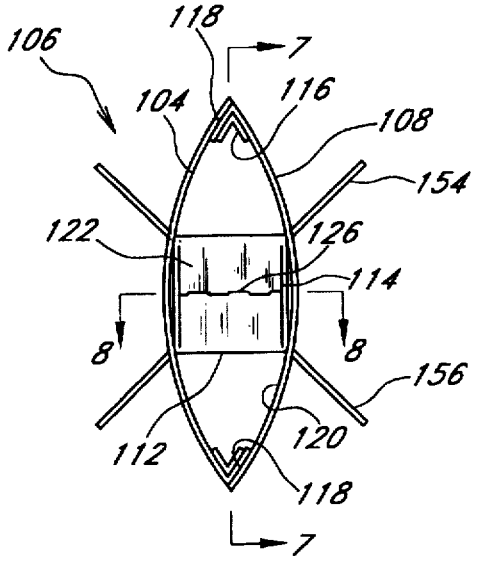
FIG. 4 is a top plan view of the embodiment of FIG. 1.
Figure 5:
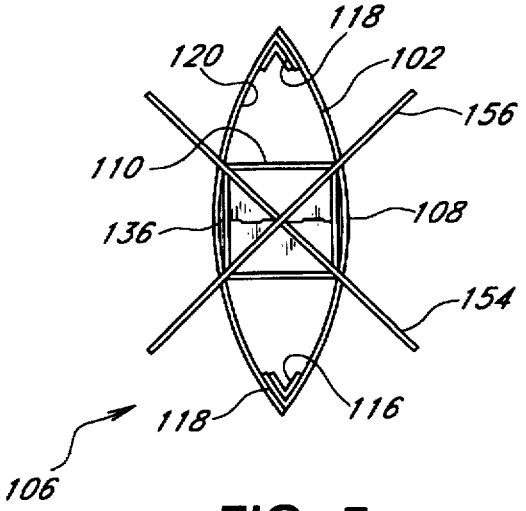
FIG. 5 is a bottom plan view of the embodiment of FIG. 1.

Referring to FIGS. 4 and 5, each display unit 102, 104 is formed of two substantially equal segments of cardboard which are folded along one long side. The folded portion 118 of one segment is preferably glued to an inner surface 120 of the other cardboard segment. The resulting rectangular display surfaces 108 are preferably about 20×30 inches or 30×40 inches, as desired. Alternatively, each display unit may be manufactured from one large piece of cardboard which is folded in two places and then glued to form a continuous loop of cardboard having two sides, as will be easily understood by those of skill in the art.

Preferably, E-flute cardboard varnished on both sides is used for the display units 102, 104 and support columns 110, 112 in the present invention, although other lightweight, durable materials having suitable characteristics may alternatively be used. Also preferably, a natural glue is used to attach the cardboard segments of each display unit 102, 104 and support columns 110, 112 in order to facilitate recycling of the components of the display stand 100.

As further shown in FIGS. 4 and 5, the stacked inner support columns 110, 112 provide stability to the display stand and also keep the display units 102, 104 curved outwardly. Preferably, the support columns 110, 112 are substantially square shaped in cross-section; although, in alternative embodiments, and according to the cross-sectional shape of the display units, the support columns may comprise other shapes. These columns 110, 112 are preferably formed from folded and glued rectangular segments of cardboard, preferably E-flute, to be collapsible to a substantially flat profile in a manner well known to those skilled in the art.

It is preferred that each support column 110, 112 have substantially the same height as each display unit 102, 104, such that a single display unit may be used in an alternative embodiment of a display stand of the present invention. That is, the support columns preferably extend a vertical distance substantially the same as the stacked height of the display units. Preferably, up to about 5 support columns and display units may be stacked to form a display stand of the present invention.

Figure 6:
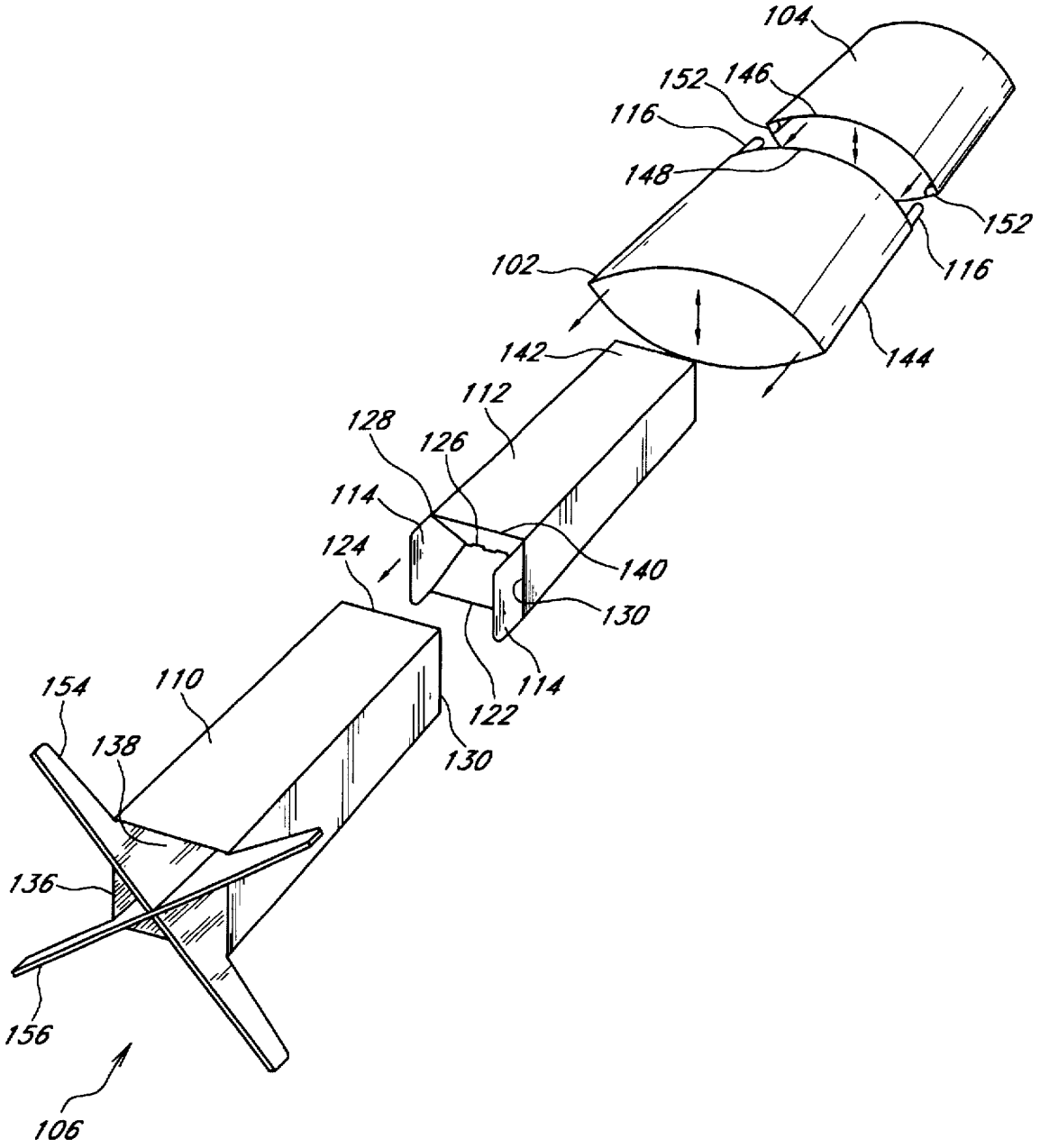
FIG. 6 is an exploded view of the embodiment of FIG. 1 illustrating the interior support elements.
Figure 8:
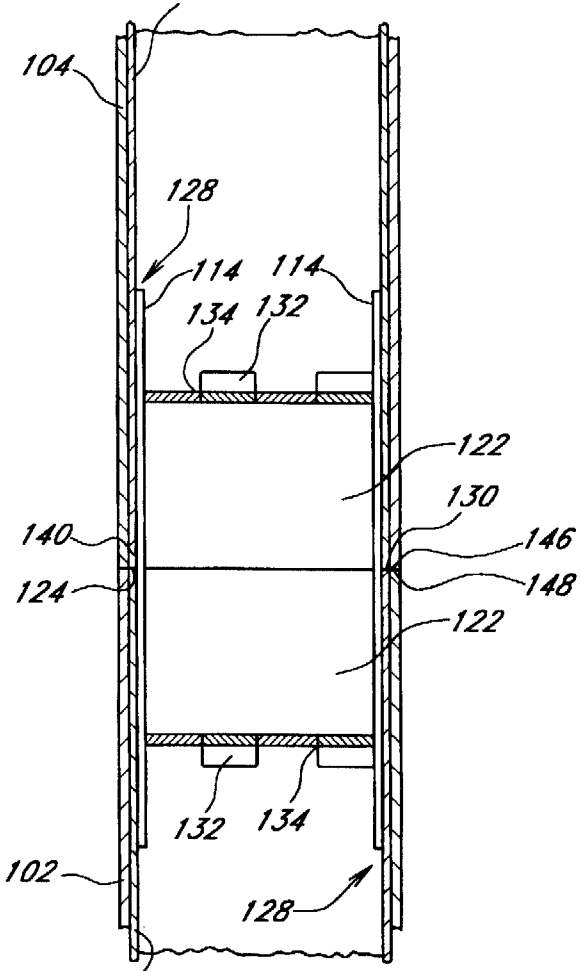
FIG. 8 is a cross-sectional view taken along lines 8—8 of FIG. 4.
Figure 7:
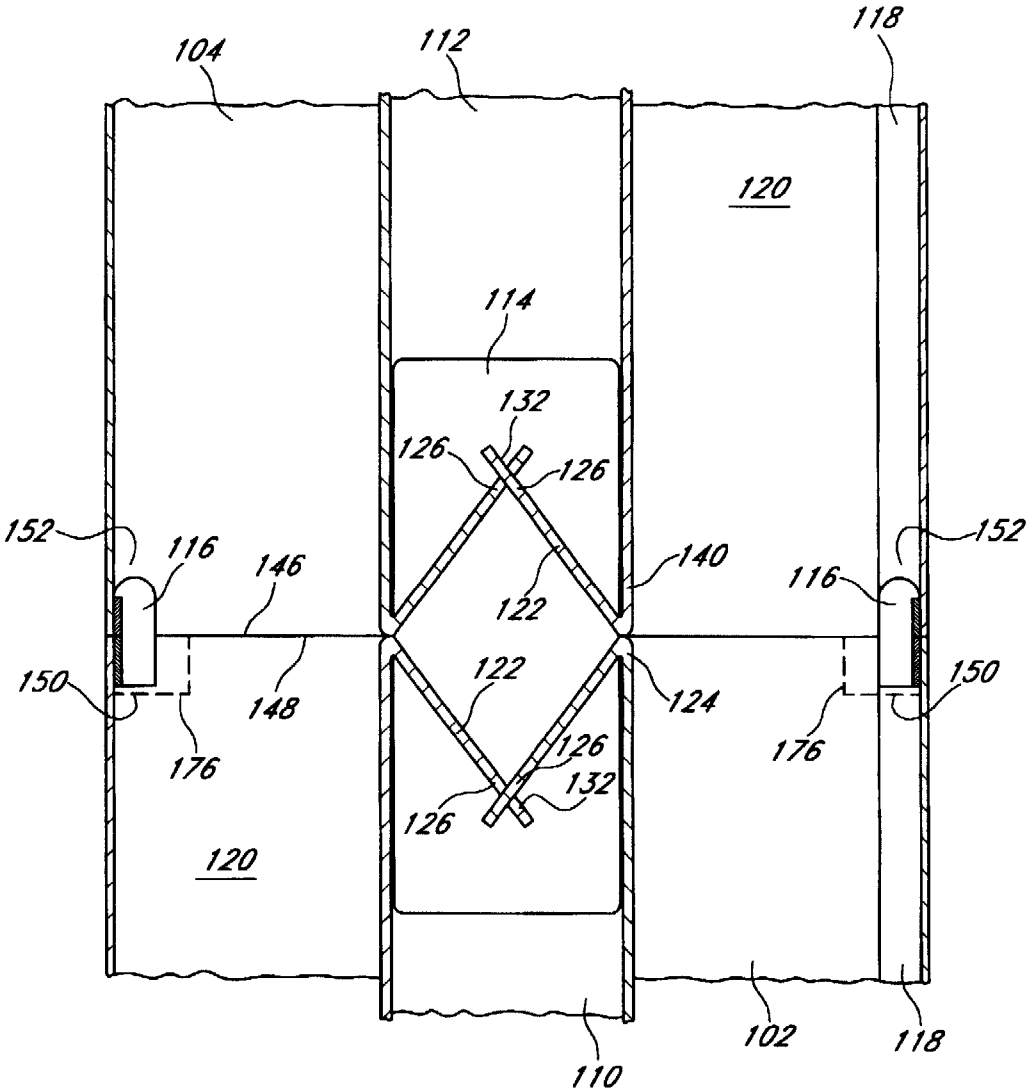
FIG. 7 is a cross-sectional view taken along lines 7—7 of FIG. 4.

Regardless of how many columns comprise the display stand, each of the support columns except the lowermost column 110 is provided with a pair of opposing flaps 122 at each end (FIGS. 4 and 6). Referring to FIG. 6, the lowermost column 110, as will be clear from the following description, preferably has flaps 122 only at its upper end 124. These flaps help to keep the otherwise collapsible columns 110, 112 in their substantially square cross-sectional shape. Each of the flaps 122 extends more than half way across the width of the column, and an end 126 of each flap is configured to engage the end of the opposing flap. The flaps 122 are positioned inside the column 110, 112, forming a V-shape with its apex extending toward the center of the column. The width of each flap 122 is slightly less than the inner dimension of the column 110, 112 such that a space 128 approximately the thickness of the cardboard material is left between the flaps 122 and the sides of the column 110, 112 having free edges 130. Referring to FIG. 7, in a preferred embodiment, each flap end 126 comprises a series of spaced rectangular extensions 132 arranged in alternating fashion such that a first flap's extension 132 is received in a second flap's space 134, and vice-versa, for secure engagement of the flaps 122 (FIG. 8). Other methods of engaging the flaps, such as saw-tooth extensions or the like, may be used in alternative embodiments, as will be readily understood by those of skill in the art.

Referring now in detail to FIG. 6, the assembly and additional elements of the embodiment of FIG. 1 are described. First, the base 106 is formed into its X-shape and a lower, open end 136 of the lower or first column 110 is placed over a central portion 138 of the base 106, as will be described in greater detail with reference to FIGS. 9*a* and 9*b*. The flaps (not shown) at the upper end 124 of the first column 110 are arranged inside the column 110. The second or upper column 112 similarly has a set of flaps 122 at each of its ends 140, 142 arranged inside the column 112. Connector cards 114, described with reference to FIGS. 10*a* and 10*b*, below, are placed in the open spaces 128 formed between the flaps 122 and side edges 130 of the lower end 140 of the second column 112. The second column 112 is aligned with the first column 110 such that the cards 114 are received into the spaces 128 in the upper end 124 of the column 110, between the free edges of the column 110 and the flaps (not shown). Alternatively, the cards 114 may first be placed into the upper end 124 of the first column 110 and the second column 112 positioned over the cards 114. Thus, the base 106 and columns 110, 112 are readily assembled to form a stable vertical arrangement.

Figure 11A:
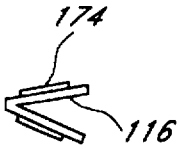
FIG. 11*a* is a top view of a folding tab illustrating the tab ready to be inserted.
Figure 11B:
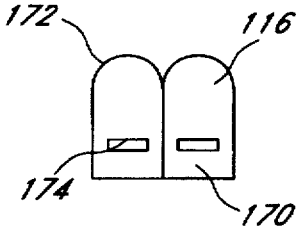
FIG. 11*b* is a front elevational view of the tab of FIG. 11*a*, illustrating the adhesive strips used to mount the tab to the display unit.

Next, force is applied to folded sides 144 of the display unit 102 which is to form the lower portion of the display stand 100, thereby creating the generally elliptic shape from the flat rectangular segments. The curved surfaces 108 of this display unit 102 are lowered over the columns 110, 112 such that the first column 110 is substantially enclosed by the display unit 102. Alternatively, the display unit 102 may be positioned over the first column 110 prior to mounting the second column 112 on top of the first column 110. In a similar fashion, the upper display unit 104 is formed into its elliptical shape and positioned over the second column 112. A lower edge 146 of the upper unit 104 preferably rests on an upper edge 148 of the lower unit 102. Preferably, alignment tabs 116, as shown and described in connection with FIGS. 11*a* and 11*b*, are secured to inner corners 150 (FIG. 7) of the upper edge 148 of the lower unit 102 such that inner corners 152 of the lower edge 146 of the upper unit 104 are kept in alignment with the corner 150 of the first display unit 102. That is, the tabs 116 prevent the upper display unit 104 from twisting out of alignment with the lower display unit 102. The longitudinal axis of the display units 102, 104 may form a line substantially parallel to the cards 114, as shown in FIGS. 4 and 5, or, alternatively, the longitudinal axis of the display units 102, 104 may form a plane substantially orthogonal to the cards 114, as indicated in FIG. 6.

Referring to FIGS. 7 and 8, the inwardly extending flaps 122, and the preferred manner in which they engage, are shown at the junction of the support columns 110, 112. The close fit of the cards 114 in the spaces 128 of the column ends 124, 140 is also shown. Although it is preferred to have the support column and display unit heights substantially the same, the lower column 110 may alternatively have a shorter height so that the junction 146, 148 of the display units 102, 104 is located above the junction of the column ends 124, 140. For ease in manufacturing, the columns 110, 112 may be manufactured to have a standard height, such as 30 inches, even though they may be used with display units 102, 104 up to 40 inches high, for example. The advantages of the present invention are still realized, so long as the support columns 110, 112 extend the majority of the height of the display stand 100.

Figure 9A:
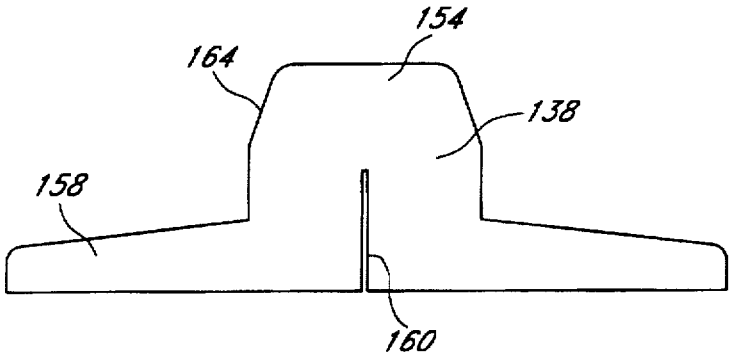
FIGS. 9*a* and 9*b* are front elevational views of a preferred embodiment of upper and lower base portions, respectively, of the display stand of FIG. 1.
Figure 9B:
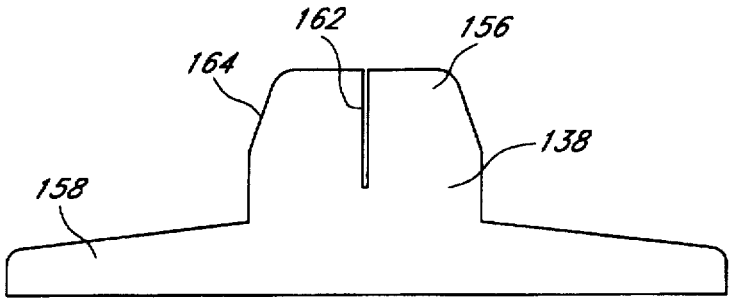

Referring to FIGS. 9*a* and 9*b*, a preferred base 106 for the display stand 100 is shown. Generally, the base 106 comprises two similar, flat members 154, 156 having outer portions 158 extending a shorter distance above the ground than central portions 138. A slot 160 centrally located on the bottom edge of one member 154 engages a slot 162 centrally located on the upper edge of the other member 156. The slots 160, 162 are approximately the thickness of the members 154, 156 to tightly secure them to each other in an X-shape. Preferably, upper sides 164 of the central portions 138 are tapered, and the corners rounded, to facilitate the positioning of the lower support column 110 over the central portions 138 of the base 106. The central portions 138 of each member 154, 156 are sized to diagonally bisect the interior square shape of the bottom end 136 of the lower support column 110, with the bottom end 136 resting on top of the outer portions 158 of the base 106. Alternatively, collapsible bases having other shapes, such as cylindrical or square, may be used with the present invention, as will be understood by those skilled in the art. In the preferred embodiment, the base members 154, 156 are formed from extruded plastic. However, other durable materials formed by other methods may be used as are known to those skilled in the art.

Figure 10A:
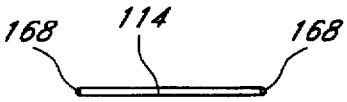
FIGS. 10*a* and 10*b* are top plan and front elevational views, respectively, of a preferred embodiment of a connector element of the resent invention.
Figure 10B:
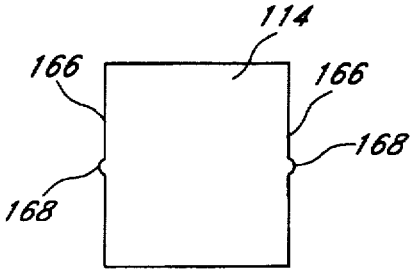

Referring to FIGS. 10*a* and 10*b*, a flat, card connector 114 preferably is sized to fit closely in the spaces 128 of the column ends 124, 140, 142. Opposing sides 166 of the card 114 preferably comprise slight protrusions 168. The protrusions 168 are centrally located along the sides 166 so that each half of the card 114 is received into an adjacent column 110, 112, and the protrusions 168 prevent the card 114 from slipping too far into one of the columns 110, 112, especially when force is applied during the assembly of the display stand 100. The cards 114 are preferably formed of E-flute cardboard for economy and streamlined manufacture of the elements of the display stand 100.

Referring to FIGS. 11*a* and 11*b*, a preferred folding tab 116 for aligning the display units 102, 104 is shown. The tab 116 comprises a flat, somewhat rectangular cardboard segment 170 (FIG. 11*b*) which is folded (FIG. 11*a*) to be inserted into the corners 150, 152 of the display units 102, 104. Preferably, upper edges 172 are rounded to facilitate mounting of the corners 152 of the upper display unit 104 on top of the tabs 116 secured to the corners 150 of the lower display unit 102. The tab 116 is shown with adhesive strips 174 for securing the tab 116 to the upper corners 150 of the lower unit 102. A removable cover for the strips 174 prevents the tab 116 from sticking to anything before assembly of the display stand 100. Alternatively, pockets 176 may be provided on the inner surface 120 at the corners 150 of the lower unit 102 for holding the tab 116, as shown in phantom in FIG. 7. The size, shape and fastening methods of the alignment tab may vary in alternative embodiments as known to those skilled in the art, or, alternatively, the tabs 116 may be omitted.

Figure 12:
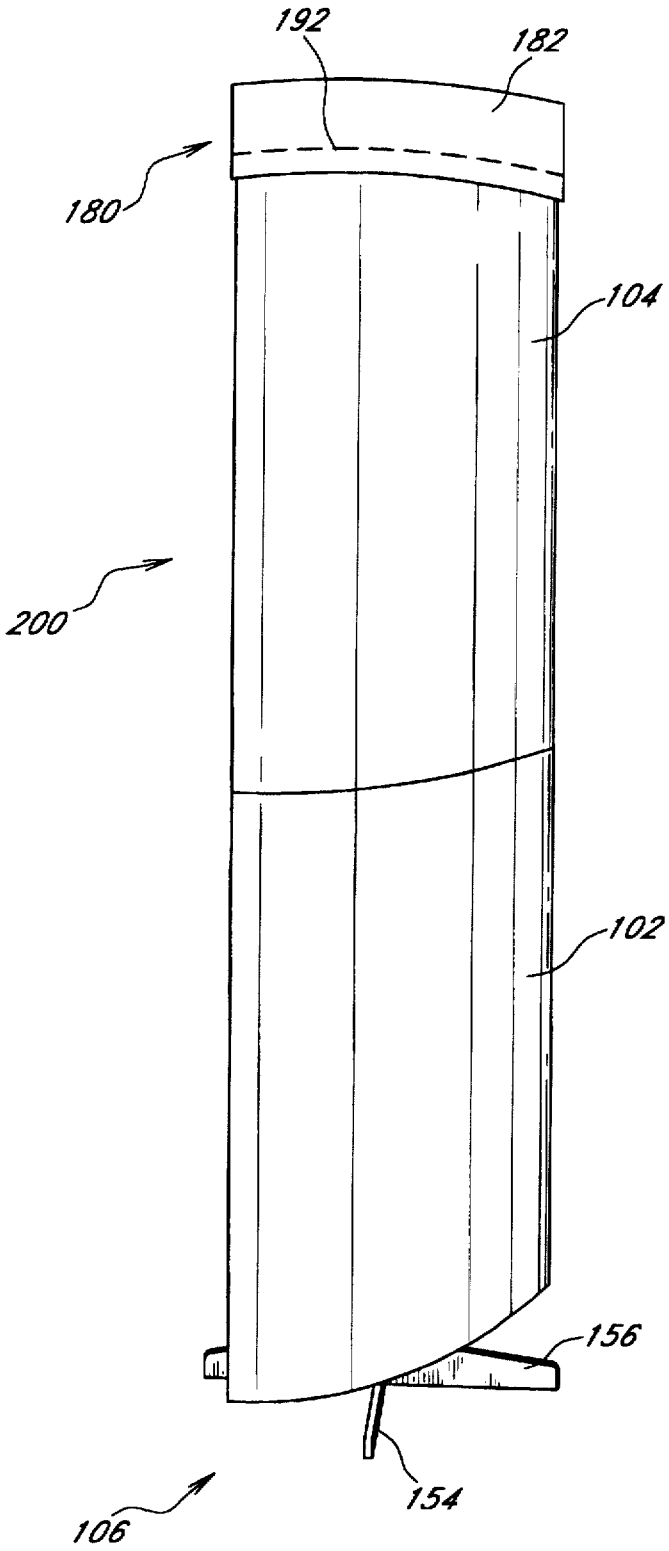
FIG. 12 is a perspective view of a second preferred embodiment of a display stand of the present invention having a header at the top of the upper display unit.

FIG. 12 illustrates another preferred embodiment of the present invention further comprising a display header 180 for the top of a display stand 200. The header 180 preferably comprises a display portion 182 having a message or name printed on its outer surfaces and a pair of support connectors 184 attached to the inside of the display portion 182. The support connectors 184 are glued onto the display portion 182 such that the header 180 folds substantially flat for storage, and during use the connectors 184 unfold to extend laterally between fold ends 186 of the display portion 182.

Figure 13:
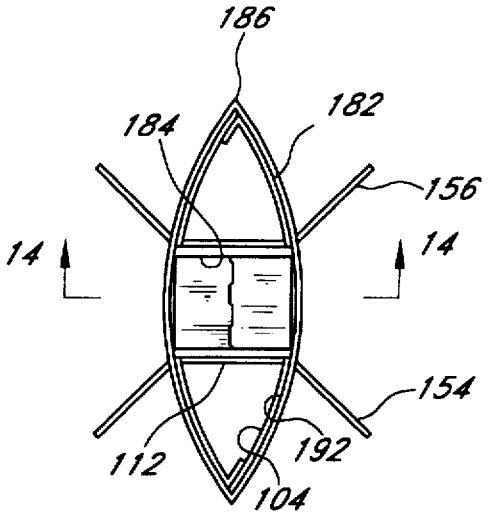
FIG. 13 is a top plan view of the embodiment of FIG. 12.
Figure 14:
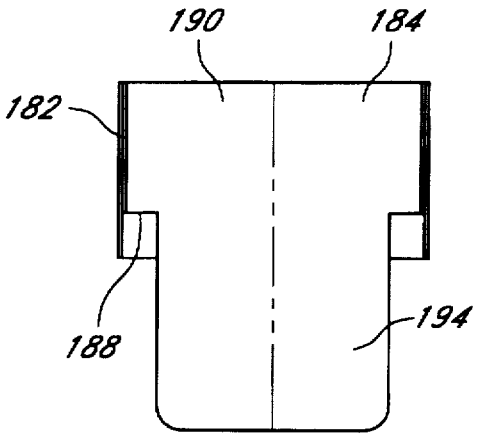
FIG. 14 is a cross-sectional view of the header taken along lines 14—14 of FIG. 13 and illustrating one of the pair of support connectors provided in the header.

As shown in FIG. 13, the display units 102, 104 are preferably stacked on the support columns 110, 112 in the manner indicated by FIG. 6. Referring to FIG. 14, it can be seen that lower edges 188 of an upper section 190 of the support connectors 184 come to rest on an upper end 192 of the display stand 200. The display portion 182 extends below the upper section 190 of the support connectors 184 such that the display portion 182 of the header 180 surrounds the upper end 192 of the display stand 200. A lower section 194 of the support connectors 184 is sized similar to the connector cards 114 and is similarly received between the flaps 122 and free edges 130 of the top 142 of the upper support column 112. Thus, the header 180 is securely engaged to the top of the display stand 200, without worry of it becoming dislodged before the display stand is disassembled for storage or recycling.

An important feature of the present invention is the quick and easy assembly of the display stand from its separate, flat elements to a tall yet stable configuration. In a preferred method of constructing a display stand of the present invention, the assembly of the stand comprises the steps of i) providing a base 106; ii) mounting a first support column 110 on top of the base 106 with a portion 138 of the base received into the bottom 136 of the first column 110; iii) inserting cards 114 into the top 124 of the first column 110; iv) mounting a second support column 112 on top of the first column 110 wherein the cards 114 are removably received into the bottom 140 of the second column 112; v) arranging a first display unit 102 around the first column 110; and vi) arranging a second display unit 104 around the second column 112 so that the second display unit 104 rests on the first display unit 102.

Steps iii)–vi) may be repeated for any number of display units and columns, although, it is preferred that up to about five display units are stacked. Further, this method may comprise the step of providing alignment tabs 116 between adjacent display units. In addition, the method may further comprise the step of detachably arranging a display header 180 on the top of the display stand.

Thus, the display stand 100, 200 of the present invention offers convenience and economy in addition to the stability of its construction. Advantageously, the display stand is simple to assemble without tools and economical to send due to the substantially flat container required for shipping the display stand. Further economy is realized by the use of recyclable materials (cardboard, glue) and reusable bases. Manufacturing and inventory are streamlined by standard sized support columns which can be used with customized display units.

The embodiments illustrated and described above are provided merely as examples of the display stand of the present invention. Other changes and modifications can be made from the embodiments presented herein by those skilled in the art without departure from the spirit and scope of the invention, as defined by the appended claims.

What is claimed is:

1. A portable display stand, comprising:

a base, said base having at least one support arm and a central portion;

a first support for mounting onto said base, said first support having a first end for slidably receiving said central portion of said base and a second end, said second end having a pair of intersecting flaps;

a second support having a bottom end and a top end, each of said ends of said second support having a pair of intersecting flaps;

at least one card having opposing sides with protrusions centrally located thereon, said card having a lower segment adapted to be received within said first support and an upper segment adapted to be received within said second support for removably engaging said first and second supports; and at least one display unit, said display unit resting on said support arm of said base and substantially surrounding said first support.

2. The portable display stand of claim 1, wherein said stand further comprises two display units, said first display unit substantially surrounding said first support and said second display unit substantially surrounding said second support, wherein said first support rests on said support arm of said base and wherein said second display unit rests on said first display unit.

3. The display stand of claim 2, further comprising at least one tab assisting in aligning said first and second display units.

4. The display stand of claim 3, wherein said first display unit contains at least one pocket for receiving said tab.

5. The display stand of claim 3, wherein said tab is adhered to at least one of said display units.

6. The display stand of claim 1, further comprising a display header removably secured to said stand.

7. The display stand of claim 5, wherein said header overhangs said display unit.

8. The display stand of claim 1, wherein said central portion of said base is tapered to facilitate slidably receiving said first support.

9. A portable display stand, comprising:

a base having substantially flat first and second members, said members removably coupled;

a first vertical support for mounting onto said base, a portion of said base adapted to extend into a lower end of said first support;

a second vertical support mounted on top of said first support, said supports configured to fold substantially flat for storage;

a pair of cards adapted to be received into an upper end of said first support and a lower end of said second support, said cards securely maintaining said supports in a stacked arrangement; and first and second display units having printed material formed on outward facing surfaces and adapted to fold substantially flat for storage, said first unit arranged to substantially surround said first support, said second unit arranged to substantially enclose said second support;

wherein a stable arrangement is achieved by said supports extending substantially the height of said display stand.

10. The display stand of claim 9, wherein connecting elements are provided between said display units to align said outward surfaces.

11. The display stand of claim 9, further comprising a third vertical support, a third display unit and a second pair of cards for retaining said third support in alignment with said second support.

12. The display stand of claim 11, further comprising a fourth vertical support, a fourth display unit and a third pair of cards for retaining said fourth support in alignment with said third support.

13. The display stand of claim 12, further comprising a fifth vertical support, a fifth display unit and a fourth pair of cards for retaining said fifth support in alignment with said fourth support.

14. The display stand of claim 9, wherein said outward surfaces of said display units measure about 20×30 inches.

15. The display stand of claim 9, wherein said outward surfaces of said display units measure about 30×40 inches.

16. The display stand of claim 9, further comprising a header adapted to be removably secured to said display stand.

17. The display stand of claim 9, wherein said base is formed from extruded plastic.

18. The display stand of claim 9, wherein said supports are formed from E-flute cardboard.

19. The display stand of claim 18, wherein said cardboard is varnished.

20. A method of constructing a display stand, comprising the steps of:

providing a base;

mounting a first support column to said base, a portion of said base being received into said first column;

inserting connectors into said first column;

mounting a second support column in alignment with said first column, said connectors removably received into said second column;

arranging a first display unit around said first column, said first display unit resting on said base;

arranging a second display unit around said second column, said second display unit resting on said first display unit, said display units having printed matter provided on their outer surfaces, and providing alignment tabs between said first and second display units.

21. The method of claim 20, further comprising the step of detachably arranging a display header on said display stand.

22. The method of claim 20, wherein said mounting and arranging steps are repeated.

* * * * *